US007174926B1

(12) United States Patent
Grantham

(10) Patent No.: US 7,174,926 B1
(45) Date of Patent: Feb. 13, 2007

(54) VAPOR RECOVERY SYSTEM WITH IMPROVED ORVR COMPATIBILITY AND PERFORMANCE

(75) Inventor: Rodger P. Grantham, Springfield, MO (US)

(73) Assignee: Vapor Systems Technologies, Inc., Dayton, OH (US)

( * ) Notice: Subject to any disclaimer, the term of this patent is extended or adjusted under 35 U.S.C. 154(b) by 30 days.

(21) Appl. No.: 10/970,558

(22) Filed: Oct. 21, 2004

Related U.S. Application Data

(63) Continuation-in-part of application No. 10/684,051, filed on Oct. 10, 2003, now Pat. No. 6,810,922.

(51) Int. Cl.
*B65B 1/04* (2006.01)

(52) U.S. Cl. ..... 141/59; 141/301

(58) Field of Classification Search ..... 141/59, 141/98, 286, 301, 302, 46; 251/284, 330
See application file for complete search history.

(56) References Cited

U.S. PATENT DOCUMENTS

| | | | | |
|---|---|---|---|---|
| 3,768,777 | A * | 10/1973 | Hechler, IV | 251/319 |
| 4,056,131 | A | 11/1977 | Healy | |
| 4,057,085 | A | 11/1977 | Shihabi | 141/59 |
| 5,035,271 | A | 7/1991 | Carmack et al. | |
| 5,040,577 | A | 8/1991 | Pope | |
| 5,141,037 | A | 8/1992 | Carmack et al. | |
| 5,197,523 | A | 3/1993 | Fink, Jr. et al. | |
| 5,285,744 | A | 2/1994 | Grantham et al. | |
| 5,537,911 | A | 7/1996 | Ohlrogge et al. | |
| 5,592,963 | A | 1/1997 | Bucci et al. | |
| 5,592,979 | A | 1/1997 | Payne et al. | |
| 5,620,031 | A | 4/1997 | Dalhart et al. | |
| 5,626,649 | A | 5/1997 | Nanaji | |
| 5,636,667 | A | 6/1997 | Young et al. | |
| 5,655,576 | A | 8/1997 | Leininger et al. | |
| 5,676,181 | A | 10/1997 | Healy | |
| 5,678,614 | A | 10/1997 | Grantham | |
| 5,720,325 | A | 2/1998 | Grantham | |
| 5,765,603 | A | 6/1998 | Healy | |
| 5,782,275 | A | 7/1998 | Hartsell, Jr. et al. | |
| 5,803,136 | A | 9/1998 | Hartsell, Jr. | |
| 5,843,212 | A | 12/1998 | Nanaji | |

(Continued)

FOREIGN PATENT DOCUMENTS

| | | |
|---|---|---|
| GB | 2311768 | 8/1997 |

*Primary Examiner*—Steven O. Douglas
(74) *Attorney, Agent, or Firm*—Stevens & Showalter LLP

(57) ABSTRACT

A fueling and associated vapor recovery system maintains the same, or lower, vacuum level in the vapor hose during ORVR vehicle refueling as that seen during a non-ORVR refueling. A valve assembly is made as either a part of the end of the vapor recovery hose assembly, a separate unit that is placed between the hose assembly and the nozzle, or incorporated directly into the nozzle. The valve assembly is biased to one position by a spring to which is attached a sliding valve member. The force of the spring is sufficient to keep the valve member in the original position when refueling non-ORVR vehicles so that the vapor hose is unobstructed and an air bleed hole is closed. When refueling an ORVR vehicle, the elevated vacuum level moves the valve member to a second position which blocks off the vapor hose from the vacuum pump and opens up the vapor hose to the air bleed hole.

24 Claims, 5 Drawing Sheets

U.S. PATENT DOCUMENTS

| | | | | |
|---|---|---|---|---|
| 5,857,500 | A | 1/1999 | Payne et al. | |
| 5,860,457 | A | 1/1999 | Andersson | |
| 5,871,651 | A | 2/1999 | McSpadden | |
| 5,944,067 | A | 8/1999 | Andersson | |
| 5,988,232 | A | 11/1999 | Koch et al. | |
| 6,059,856 | A | 5/2000 | Ohlrogge et al. | |
| 6,070,156 | A | 5/2000 | Hartsell, Jr. | |
| 6,082,415 | A | 7/2000 | Rowland et al. | |
| 6,095,204 | A | 8/2000 | Healy | |
| 6,102,085 | A | 8/2000 | Nanaji | |
| 6,103,532 | A | 8/2000 | Koch et al. | |
| 6,123,118 | A | 9/2000 | Nanaji | |
| 6,151,955 | A | 11/2000 | Ostrowski et al. | |
| 6,332,483 | B1 | 12/2001 | Healy | |
| 6,334,470 | B2 | 1/2002 | Healy | |
| 6,532,999 | B2 | 3/2003 | Pope et al. | |
| 6,810,922 | B1 * | 11/2004 | Grantham | 141/59 |

* cited by examiner

VAPOR RECOVERY SYSTEM WITH IMPROVED ORVR COMPATIBILITY AND PERFORMANCE

This is a continuation-in-part of U.S. patent application Ser. No. 10/684,051, filed Oct. 10, 2003, now U.S. Pat. No. 6,810,922, which is hereby incorporated by reference herein in its entirety.

BACKGROUND OF THE INVENTION

This invention relates generally to vapor recovery systems associated with the refueling of vehicles. More particularly, this invention relates to a modification made to an assist type of vapor recovery system to improve the performance and compatibility of the system when it is used for refueling vehicles that have on board refueling vapor recovery (ORVR) systems.

In fuel dispensing systems, such as those used for delivering gasoline to the fuel tank of a vehicle, environmental protection laws require that vapors emitted from the tank during the fuel dispensing process be recovered. Fuel is customarily delivered through a nozzle via a fuel hose and vapors are recovered from the nozzle via a vapor hose that conveys the vapor to the storage tank from whence the fuel came. In what is referred to as a balanced system, the vapors are forced through the vapor hose by the positive pressure created in the vehicle tank as the fuel enters it. In other systems, referred to as assist-type systems, the vapor is pumped from the vehicle tank and forced into the storage tank by a vapor recovery system connected to the vapor hose. Currently, many fuel dispensing pumps at service stations are equipped with vacuum assisted vapor recovery systems that collect fuel vapor vented from the fuel tank filler pipe during the fueling operation and transfer the vapor to the fuel storage tank.

Recently, onboard, or vehicle carried, fuel vapor recovery and storage systems (commonly referred to as onboard refueling vapor recovery or ORVR) have been developed in which the head space in the vehicle fuel tank is vented through a charcoal-filled canister so that the vapor is absorbed by the charcoal. Subsequently, the fuel vapor is withdrawn from the canister into the engine intake manifold for mixture and combustion with the normal fuel and air mixture. The fuel tank head space must be vented to enable fuel to be withdrawn from the tank during vehicle operation. In typical ORVR systems, a canister outlet is connected to the intake manifold of the vehicle engine through a normally closed purge valve. The canister is intermittently subjected to the intake manifold vacuum with the opening and closing of the purge valve between the canister and intake manifold. A computer which monitors various vehicle operating conditions controls the opening and closing of the purge valve to assure that the fuel mixture established by the fuel injection system is not overly enriched by the addition of fuel vapor from the canister to the mixture.

Fuel dispensing systems at service stations having vacuum assisted vapor recovery capability which are unable to detect ORVR systems waste energy, increase wear and tear, ingest excessive air into the underground storage tank and cause excessive pressure buildup in the piping and underground storage tank due to the expanded volume of hydrocarbon saturated air.

Refueling of vehicles equipped with ORVR can be deleterious for both the vapor recovery efficiency of a vapor recovery system and the durability of some system components. The refueling of an ORVR equipped vehicle deprives the vapor recovery system of any gasoline vapors intended to be returned to the storage tank, typically located underground. In lieu of having gasoline vapor available, the vapor pump of an assist-type system will pump air back into the storage tank. The air pumped back into the storage tank vaporizes liquid fuel that is in the storage tank, pressurizes the ullage space of the storage tank and is then vented to the atmosphere as polluting emissions.

One of the known types of vapor recovery systems that attempts to avoid these problems is the balance type of vapor recovery system. The balance system does not use a vapor pump, but simply allows the free exchange of vapor between the gasoline tank of the vehicle being refueled and the storage tank. Since the balance system does not allow air to be induced into the storage tank when refueling an ORVR equipped vehicle, the vapor growth problem is avoided and, in fact, the storage tank pressures are typically reduced by the removal of liquid and possibly vapor. The reduction in vapor flow rate when refueling an ORVR vehicle is about 100% (i.e., no vapor or air flow to the storage tank).

One known type of assist vapor recovery system attempts to avoid the storage tank pressurization problem by sensing the presence of an ORVR equipped vehicle during refueling and uses this information to turn off the vapor pump during the refueling of an ORVR vehicle. The systems ability to recognize an ORVR system and adjust the fuel dispenser's vapor recovery system accordingly eliminates the redundancy associated with operating two vapor recovery systems for one fueling operation. One example of this type of system is described in U.S. Pat. No. 5,782,275 issued to Gilbarco and hereby incorporated by reference. The reduction in vapor or air flow rate during an ORVR refueling will be 100% when the vapor pump is turned off; however, some initial run time is required for the pressure sensor to activate and turn the pump off. The particular system described in the '275 patent utilizes a hydrocarbon sensor to determine if an ORVR fueling event is occurring. If so, a signal from the sensor turns the vapor pump on/off.

Another example of an assist vapor recovery system is described in U.S. Pat. No. 6,095,204 issued to Healy and hereby incorporated by reference. The system of the '204 patent uses a pressure sensor in place of the hydrocarbon sensor to determine if an ORVR refueling event is taking place and subsequently turn the vapor pump on/off. Therefore, an overall reduction of only about 75% is typical for such a system.

Another type of known assist system utilizes a vapor flow restrictor built into the nozzle to decrease the vapor flow back to the storage tank during an ORVR refueling event. The nozzle for such a system utilizes a flexible boot to engage the filler neck of a vehicle, but unlike a balance system, an air-tight seal is prevented. If an air-tight seal were present when a vapor pump is being used in conjunction with an ORVR vehicle, relatively high vacuum levels develop within the vapor space of the nozzle. These abnormally high vacuum levels cause abnormal operation of the automatic shut-off mechanism in the nozzle. The nozzle for such a system utilizes either a check valve or holes in the boot itself to limit the amount of vacuum to which the nozzle is exposed. Such vacuum relief measures allow the vacuum level to increase to a detectable level within the nozzle and the elevated vacuum level is used to operate a flow restrictor in the vapor flow path. The exact reduction in vapor (air) flow rate during an ORVR refueling with such a system is from 25% to 78% depending on the exact configuration and fueling flow rate.

Another type of assist system is described in U.S. Provisional Patent Application Ser. No. 60/461,097 filed Apr. 8, 2003 and assigned to the assignee of this invention. That system utilizes an assist-type of nozzle and a balance-type flexible boot to seal against the filler neck of the vehicle being refueled. This arrangement results in relatively high vacuum levels in the nozzle vapor space. To account for those vacuum levels, the shut-off mechanism is modified. Since the nozzle boot is sealed against the vehicle's filler neck, the vapor recovery system will not ingest any air into the storage tank. The vapor flow rate will not be reduced completely 100% as with a balance system because the vapor pump will be capable of pumping some vapor from the vehicle's fuel tank. The reduction in vapor flow rate is typically about 90% with such a system.

The above-described assist vapor recovery system effectively blocks the inlet or nozzle end of the vapor hose resulting in relatively high vacuum levels in the vapor hose itself. The system described in the '204 patent does so similarly, but to a lesser degree. The vacuum levels in the vapor hose during refueling of an ORVR vehicle will be about ten times higher than the vacuum levels in the vapor hose when refueling a non-ORVR equipped vehicle. In addition, elevated vacuum levels will be present in the entire length of the vapor hose due to the drastically reduced vapor flow rate. The exterior of the vapor hose is also subjected to the fluid pressure since typically the fluid carrying hose surrounds it in a coaxial arrangement. The exterior pressure combined with the elevated interior vacuum levels presents a condition that will promote the collapse of the vapor hose tubing.

Moreover, the current trends in the industry are to increase the amount of ethanol used in gasoline fuel blends which decreases the mechanical properties of the material used in the vapor hose tubing. These factors, in combination with market movements toward single hose dispensers which increases the flexing cycle on the vapor hose tubing, result in the collapse and/or failure of the vapor hose tubing. Such problems could become systematic and present a significant issue that must be addressed.

SUMMARY OF THE INVENTION

These and other problems with known fuel dispensing and associated vapor recovery systems have been overcome with this invention. This invention maintains the same or lower vacuum levels in the vapor hose during an ORVR vehicle refueling as compared to those experienced during a non-ORVR refueling event.

The vapor recovery system of this invention includes a valve assembly contained in a housing that can be made as either a part of the end of the vapor recovery hose assembly, a separate unit that can be placed between the hose assembly and the nozzle or incorporated directly into the nozzle. The valve assembly in one embodiment includes a diaphragm attached to a sliding valve member and which is biased to one position by a spring. The chamber defined by the diaphragm and the housing is connected by a passageway to the vapor hose upstream from the valve assembly. The valve member intersects the primary vapor passage in the vapor hose. The valve member also has a stop to seal off a passageway connecting the vapor hose below the valve assembly to an air bleed hole.

The force of the spring on the diaphragm keeps the valve member in a first position when refueling non-ORVR vehicles so that the vapor hose is unobstructed and the air bleed hole is closed. When refueling an ORVR vehicle, the elevated vacuum levels in the primary vapor passage are communicated to the chamber. As a result, the valve member moves to a second position blocking off the vapor hose from the vacuum pump and opening up the vapor hose to the air bleed hole. The size of the bleed hole can be adjusted to work with the containment pumping action of the ORVR filler neck to maintain the desired vacuum level in the vapor hose to keep the valve cylinder in this second position. In an alternative embodiment, the diaphragm chamber is connected by a passageway to the primary vapor passage downstream from the valve member. When an elevated vacuum level causes the valve member to move to the second position, the vacuum level on the pump side of the valve will increase substantially, holding the valve cylinder in this position until the pump is stopped. In this configuration, the air bleed hole into the vapor hose could be made as large as desired, even to the point of reducing the vacuum in the vapor hose below the valve, including the nozzle vapor space, to zero.

In a still further embodiment of this invention, the diaphragm is eliminated from the valve assembly and the increased vacuum levels generated during an ORVR fueling event activates a vacuum relief valve poppet to increase the response time of the system and prevent or reduce the vapor flow to the storage tank. In either embodiment, the reduction in the vapor flow to the storage tank will be at or near 100%.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
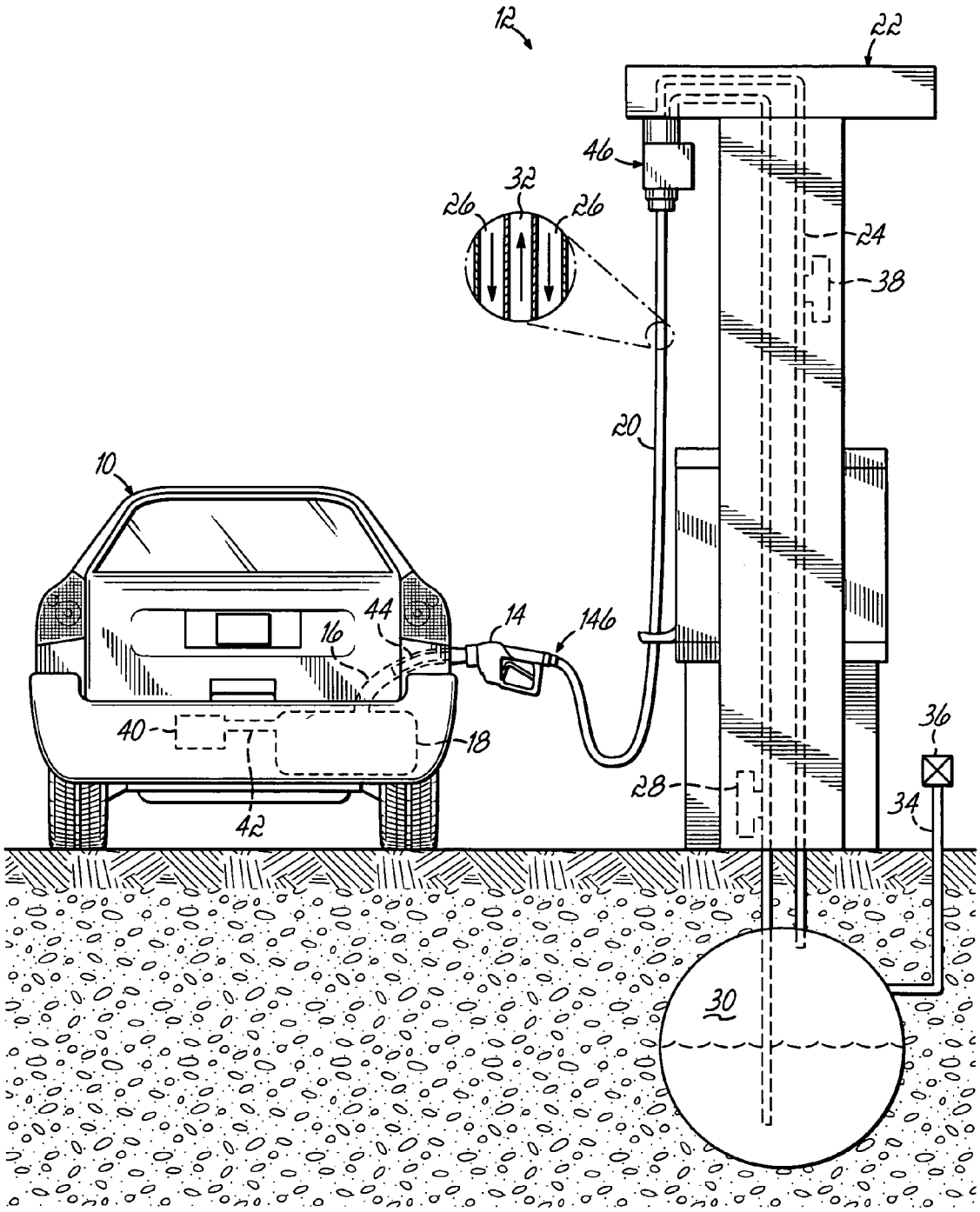
FIG. 1 is a fueling system for a vehicle according to one embodiment of this invention.

Referring to FIG. 1, a vehicle 10 is shown being fueled with a fueling system 12. A nozzle 14 is shown inserted into a filler pipe 16 of a fuel tank 18 of the vehicle 10 during the fueling operation.

A fuel delivery hose 20 is connected to the nozzle 14 on one end and to a fueling system island 22 on the opposite end. The fueling system 12 includes a vapor recovery system 24. As shown by the cut-away view of the interior of the fuel delivery hose 20, an annular fuel delivery passageway 26 is formed within the fuel delivery hose 20 for delivering fuel by a pump 28 from an underground storage tank 30 to the nozzle 14. A central, tubular vapor passage 32 as part of the vapor recovery system 24 is also within the fuel delivery hose 20 for transferring fuel vapors expelled from the vehicle's fuel tank 18 to the underground storage tank 30 during the fueling of the vehicle 10. The fuel delivery hose 20 is depicted as having the internal vapor passage 32 with the fuel delivery passage 26 concentrically surrounding it.

As shown in FIG. 1, the underground storage tank 30 includes a vent pipe 34 and a pressure vent valve 36 for venting the underground tank 30 to atmosphere. The valve 36 vents the tank 30 to air at about ±3.0 inches $H_2O$ or at about −8.0 inches $H_2O$.

A vapor recovery pump 38 provides a vacuum in the vapor passage 32 for removing fuel vapor during a refueling operation. The vapor recovery pump 38 may be placed anywhere along the vapor recovery system 24 between the nozzle 14 and the underground fuel storage tank 30. Vapor recovery systems 24 utilizing a vapor recovery pump 38 of the type shown and described herein are well known in the industry and are commonly utilized for recovering vapor during refueling of conventional vehicles which are not equipped with on-board vapor recovery systems (ORVR). The vehicle 10 as shown in FIG. 1 being fueled includes an ORVR system 40. This invention addresses the compatibility of the fueling system vapor recovery system with ORVR equipped vehicles 10.

The vehicle fuel tank 18 of an ORVR vehicle 10 has an associated on-board vapor recovery system 40. These ORVR systems 40 typically have a vapor recovery inlet 42 extending into the fuel tank 18. As the fuel tank 18 fills, pressure within the tank 18 increases and forces vapors into the ORVR system 40 through the vapor recovery inlet 42. Alternatively, the ORVR system 40 may use a check valve (not shown) along the filler pipe 16 to prevent further loss of vapors.

As liquid fuel rushes into the fuel tank 18 during the fueling operation, fuel vapors are forced out of the fuel tank 18 through the nozzle 44 of the nozzle 14. The vapor recovery system 24 pulls the fuel vapors through the hose 20 along the vapor passage 32 and ultimately into the underground tank 30. This is the standard operation when fueling vehicles not equipped with ORVR systems.

According to this invention, an ORVR compatibility assembly 46 is included in the fuel system 12 so that the vapor recovery system 24 of the fueling system 12 is compatible with the ORVR system 40 of the vehicle 10 during such a fueling operation. As shown in FIG. 1, the ORVR compatibility assembly 46 is located on the hose 20 at the opposite end from the nozzle 14; however, the compatibility assembly 46 can alternately be placed between the hose 20 and the nozzle 14, incorporated directly into the nozzle 14, or anywhere in the fueling system 12 in fluid communication with the vapor recovery system 24.

Figure 2:
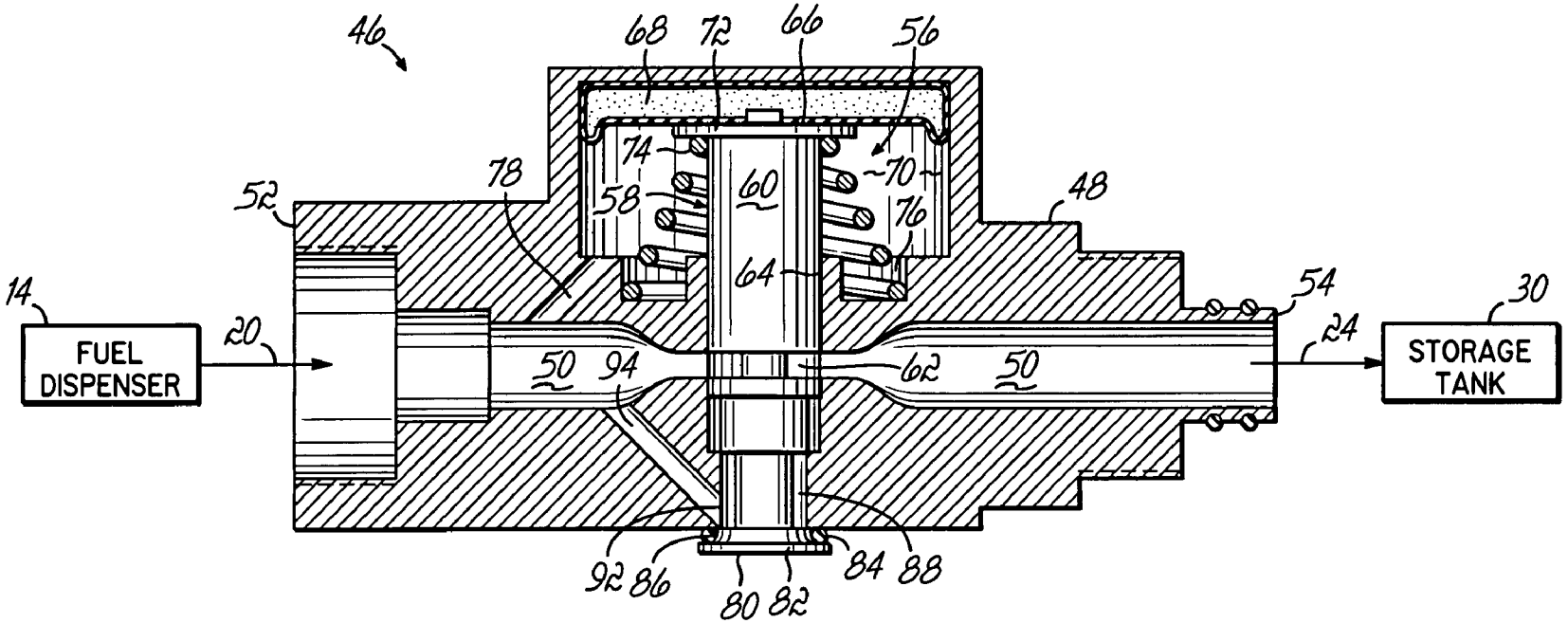
FIG. 2 is a cross-sectional view of a first embodiment of an assembly in a first position for use in a vapor recovery system of the fueling system of FIG. 1.
Figure 3:
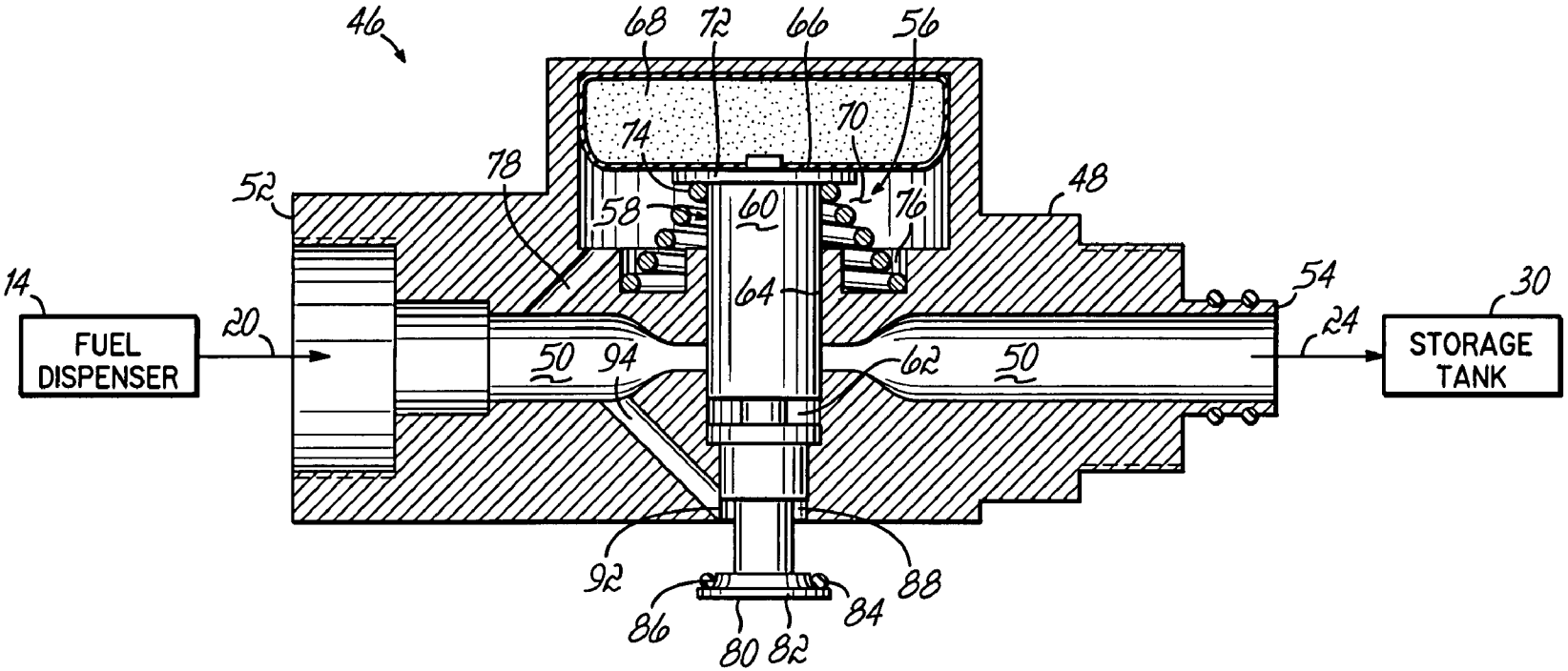
FIG. 3 is a view of the assembly of FIG. 2 in a second position.

Referring to FIGS. 2 and 3, the compatibility assembly 46 according to one embodiment of this invention includes a housing 48 with a primary vapor passage 50 there through and in communication with the vapor passage 32 in the hose 20. An upstream end 52 of the primary vapor passage 50 in the assembly 46 is connected through the hose 20 to the fuel nozzle 14 and, likewise, a downstream end 54 of the primary vapor passage 50 is in communication with the storage tank 30. For consistency herein, the end of the assembly 46 in communication with the fuel tank 18 and nozzle 14 is referred to as the upstream end 52 and the end of the assembly 46 in communication with the underground storage tank 30 is the downstream end 54.

A valve assembly 56 is mounted for reciprocal movement in the housing 48 and intersects the primary vapor passage 50 in the assembly 46. The valve assembly 56 includes a sliding valve member 58 having a generally cylindrical portion 60 and a valve passage 62 which allows for vapor flow through the primary vapor passage 50 when the valve assembly 56 is in a first position as shown in FIG. 2. The sliding valve member 58 reciprocates within a bore 64 in the housing 48 to a second position as shown in FIG. 3 in which the cylindrical portion 60 of the valve member 58 blocks or inhibits the vapor flow through the primary vapor passage 50.

An upper, proximal end 66 of the valve member 58 is connected to a diaphragm, bellows or other expansible member 68 which is captured within a chamber 70 in the housing 48. A plate 72 is mounted between the upper end 66 of the valve member 58 and the diaphragm 68. A conical spring 74 is mounted between the plate 72 on the valve member 58 and an annular groove 76 in the housing 48. The spring 74 urges or biases the valve member 58 upwardly so that the valve assembly 56 is urged toward the first position as shown in FIG. 2. A secondary vapor passage 78 connects the chamber 70 to the primary vapor passage 50 upstream from the valve assembly 56 as shown in FIG. 2. In an alternate embodiment, the secondary vapor passage 78 is connected to the chamber 70 and the primary vapor passage 50 downstream from the valve assembly 56 as shown in FIG. 4.

A terminal end 80 of the valve member 58 includes a stop 82 juxtaposed to the housing 48. An O-ring 84 is seated on a beveled surface 86 of the stop 82 for sealing an annular pocket 88 in the housing 48. A stem 90 projects from the valve member 58 through the pocket 88 and is connected to the stop 82. In the first position of the valve assembly 56 as shown in FIGS. 2 and 4, the O-ring 84 and stop 82 are seated against the housing 48 to seal off an air bleed port 92 connected to an air bleed passage 94. The air bleed passage 94 is in communication with the primary vapor passage 50 upstream from the valve assembly 56. In the second position of the valve assembly 56 as shown in FIG. 3, the valve member 58 translates to extend the stop 82 from the sealing configuration with the housing 48 thereby opening the air bleed passage 94 for communication between the ambient atmosphere and the primary vapor passage 50.

Figure 4:
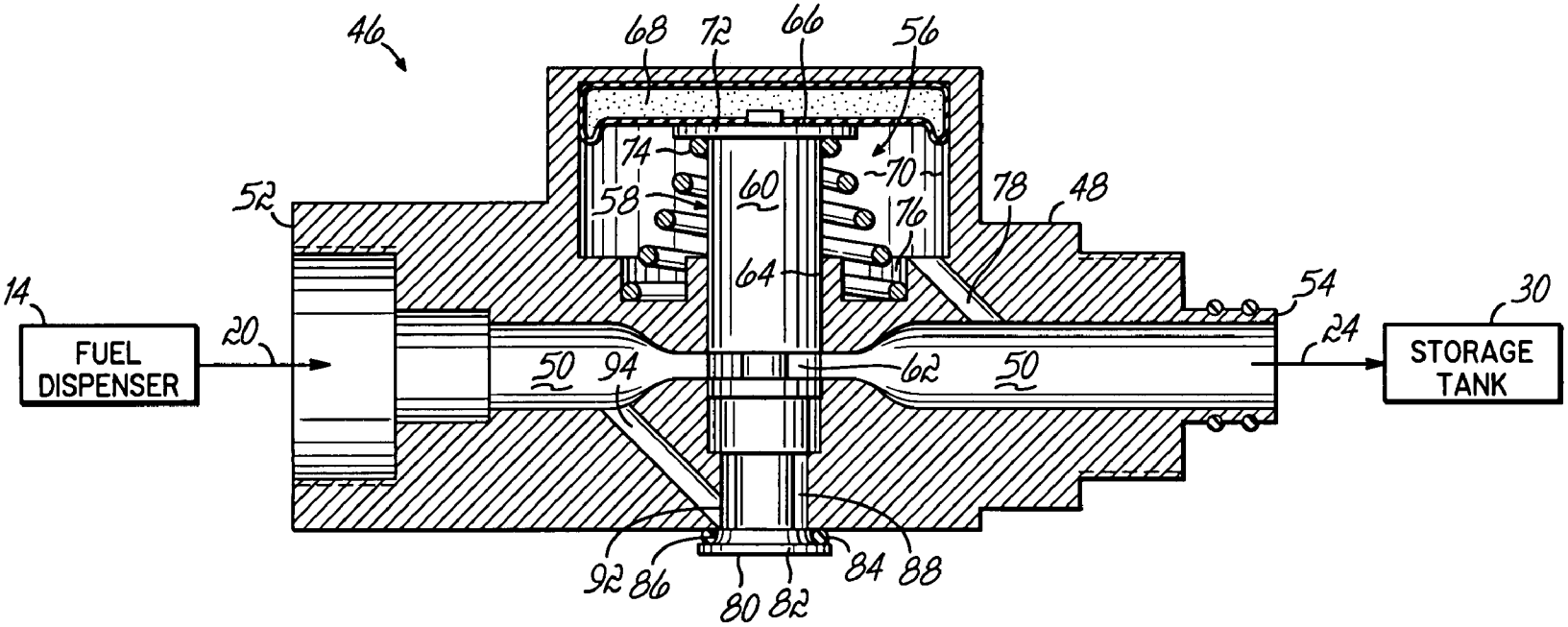
FIG. 4 is a view of an alternative embodiment of the assembly of FIG. 3 in the first position.

In operation, the force of the spring 74 on the plate 72 and diaphragm 68 keeps the valve member 58 in the first position as shown in FIGS. 2 and 4 when refueling non-ORVR vehicles so that the primary passage 50 in the assembly 46 is unobstructed and the air bleed port 92 is closed. When refueling non-ORVR vehicles, the vapor recovery system 24 in the fueling system 12 retrieves fuel vapors from the vehicle fuel tank 18 and pumps them to the ullage in the underground storage tank 30. When refueling an ORVR 40 equipped vehicle 10, elevated vacuum levels in the vapor passage 32 of the hose 20 result from the vacuum pump 38 in the vapor recovery system 24 in combination with the ORVR system 40. The elevated vacuum levels are communicated through the primary and secondary vapor passages 50, 78 to the chamber 70. As a result of the elevated vacuum levels (or reduced pressure) in the chamber 70, the diaphragm 68 expands or moves within the chamber 70 as shown in FIG. 3. The movement of the diaphragm 68 likewise moves the valve member 58 toward the second position and overcomes the bias of the spring 74 while the reduced pressure or elevated vacuum condition exists in the chamber 70.

As a result of the movement of the diaphragm 68 and plate 72, compression of the spring 74 and translation of the valve member 58, the primary vapor passage 50 is blocked off because the valve passage 62 no longer provides for the flow of vapor in the primary vapor passage 50 through the assembly 46. Moreover, the vacuum of the vapor recovery system 24 is blocked from communicating with the ORVR system 40. The valve member 58 in the second position as shown in FIG. 3 blocks off the primary vapor passage 50 from the vacuum pump 38 of the vapor recovery system 24 and opens up the primary vapor passage 50 to the air bleed port 92. The size of the air bleed port 92 can be adjusted for compatibility with the containment pumping action of the ORVR filler neck to maintain the desired vacuum level in the passage 32 in vapor hose 20 to keep the valve member 58 in the second position.

As shown in FIG. 4, in an alternative embodiment the diaphragm chamber 70 is connected by the secondary vapor passage 78 downstream from the valve assembly 56. As such, when the elevated vacuum level or decreased pressure in the chamber 70 causes the valve member 58 to move to the second position, the vacuum level on the downstream end 54 or pump side of the valve member 58 will increase substantially and hold the valve member 58 in the second position until the pump 38 is stopped. In the embodiment of FIG. 4, the air bleed port 92 into the primary vapor passage 50 could be made as large as desired and even to the point of reducing the vacuum in the passage 32 of the vapor hose 20 below the valve assembly 56, including the nozzle vapor space to nearly zero. Nevertheless, in any embodiment of this invention reduction of vapor flow in the vapor passage 32 to the storage tank 30 would be at or near 100%.

Figure 5:
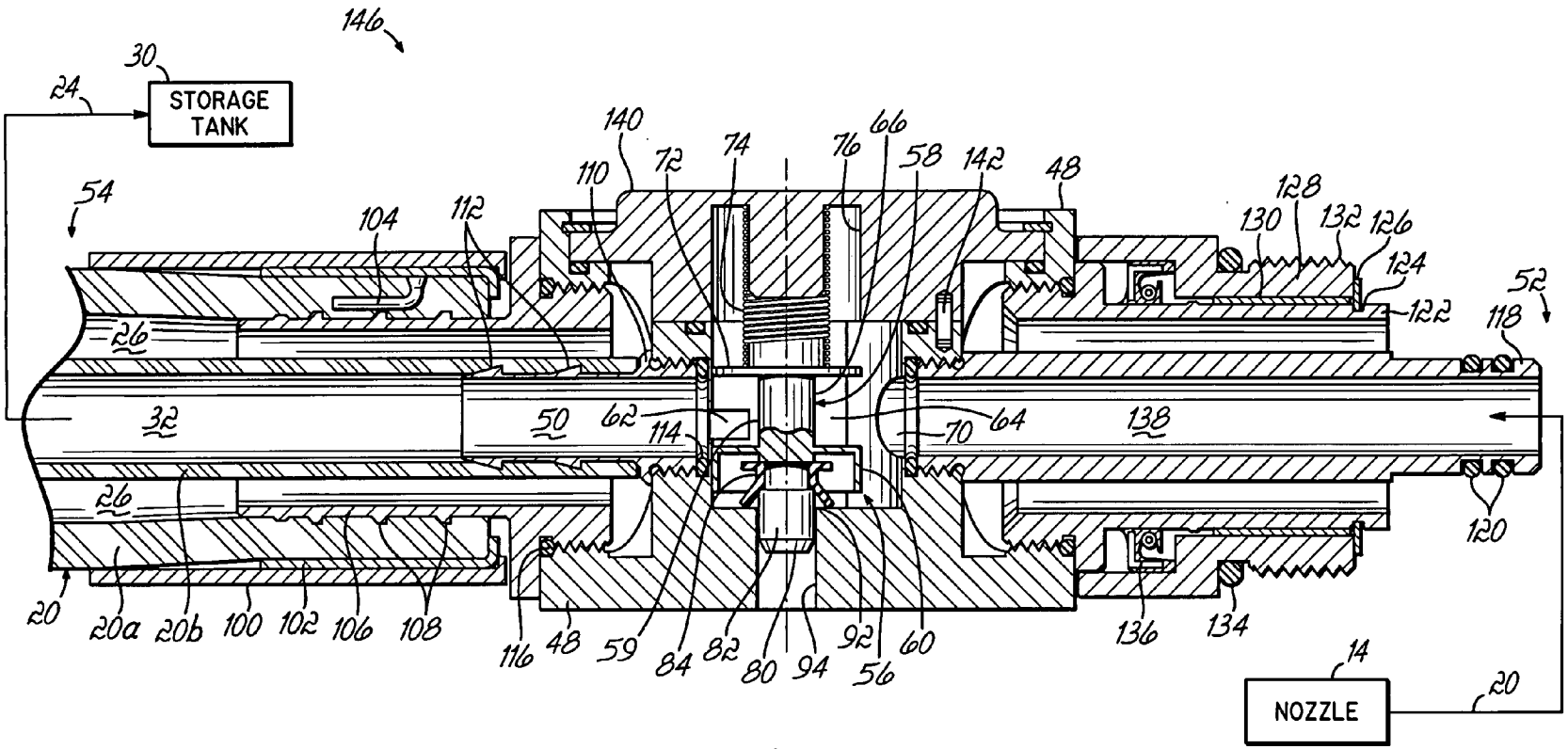
FIG. 5 is a cross-sectional view of a further alternative embodiment of an assembly for use in a vapor recovery system of the fueling system of FIG. 1.

A further alternative embodiment of an ORVR compatibility assembly 146 according to this invention is shown in FIG. 5. The ORVR compatibility assembly 146 in one embodiment is located on the hose 20 adjacent the nozzle 14 (see FIG. 1); however, the compatibility assembly 146 can alternately be placed on the hose 20 and spaced from the nozzle 14, incorporated directly into the nozzle 14, or anywhere in the fueling system 12. Specifically, the assembly 146 can be placed in a fitting that connects the hose 20 to the nozzle 14 or anywhere such that the primary vapor passage 50 and a central axial passageway 138 (described later herein) are coupled to vapor passage 32, or anywhere in the fueling system 12.

Referring to FIG. 5, the compatibility assembly 146 according to this embodiment of this invention includes a valve body 48 with a primary vapor passage 50 there through and in communication with the vapor passage 32 in the hose 20. An upstream end 52 of the primary vapor passage 50 in the assembly 146 is connected through the hose 20 to the fuel nozzle 14 and, likewise, a downstream end 54 of the primary vapor passage 50 is in communication with the storage tank 30. For consistency herein, the end of the assembly 146 in communication with the fuel tank 18 and nozzle 14 is referred to as the upstream end 52 and the end of the assembly 146 in communication with the underground storage tank 30 is the downstream end 54.

The assembly 146 according to the embodiment of this invention shown in FIG. 5 may be coupled to the hose 20 at the downstream end 54 by a ferrule sleeve 100 surrounding an inner ferrule 102 clamped onto the hose 20. A grounding brad 104 projects from the ferrule and into the hose 20. The outer hose tubing 20*a* of the hose 20 is inserted onto an outer hose crimp adapter 106 which has a series of outwardly projecting ridges 108 to engage the outer hose tubing 20*a*. The inner hose tubing 20*b* of the hose 20 is connected to the compatibility assembly 146 through an inner hose barb adapter 110 which has a number of outwardly projecting barbs 112 which engage the inner hose tubing 20*b*. The inner hose barb adapter 110 is threaded into the valve body 48 and sealed with an O-ring 114. Likewise, the outer hose crimp adapter 106 is threaded to the valve body 48 and sealed with an O-ring 116. The primary purpose of the O-rings is to maintain a sealed separation between the fuel flow passage 26 in the outer hose tubing 20*a* from the vapor flow passage 32 in the inner hose tubing 20*b* through the assembly 146.

The upstream end 52 of the compatibility assembly 146 includes an axially projecting nozzle inner adapter 118 and a pair of O-rings 120, 120 mounted on the nozzle inner adapter 118 for sealingly engaging the nozzle 14, pipe or other fluid communicating device in connection with the nozzle 14. A nozzle outer adapter 122 is concentrically mounted around the inner adapter 126 and has an annular groove 124 to receive therein a snap ring 126. The snap ring 126 retains a swivel nut 128 and a bearing sleeve 130. The swivel nut 128 includes a series of threads 132 for engaging a compatible coupling (not shown) for connection with the nozzle 14 when installing the compatibility assembly 146. An O-ring 134 is mounted around the swivel nut 128 for sealing engagement. A swivel seal 136 is captured by the swivel nut 128 to allow for rotation of the compatibility assembly 146 relative to adjacent component.

The inner adapter 118 includes a central axial passageway 138 in communication with the primary vapor passage 50 for extracting vapors from the vehicle tank 18 through the compatibility assembly 146 when the vehicle 10 does not include an ORVR system 40. However, during an ORVR fueling event, a valve assembly 56 in the valve body 48 is exposed to increased vacuum levels in the primary vapor passage 50 and the bias of the spring 74 is overcome to thereby move the valve assembly 56 to a second closed position thereby blocking the downstream end 54 of the primary vapor passage 50 and preventing communication with the ORVR system 40 on the vehicle 10. The primary vapor passage 50 in the compatibility assembly 146 is then vented through the air bleed passage 94.

The valve assembly 56 is mounted for reciprocal movement in the valve body 48 and intersects the primary vapor passage 50 in the assembly 146. The valve assembly 56 may be a poppet type valve and include a sliding valve member 58 having a stem 59 separating a cup-shaped sealing disk 60 and an upper valve plate 72 which allows vapor flow through the primary vapor passage 50 when the valve assembly 56 is in a first position as shown in FIG. 5. The sliding valve member 58 reciprocates within a bore 64 containing the slotted passage 62 in the valve body 48 to a second position (not shown in FIG. 5) in which the sealing flange 60 of the valve member 58 blocks the slotted passage 62 to inhibit the vapor flow through the primary vapor passage 50.

An upper, proximal end 66 of the valve member 58 includes the plate 72. The coil spring 74 is mounted between the plate 72 on the valve member 58 and an annular socket 76 in a valve cap 140 which is seated in the valve body 48. In one embodiment, the spring 74 is a closed end, compression spring made of 302/304 stainless steel. Further, the spring 74 in one embodiment has a free length of 1.00 inches, a solid height of 0.503 inches and a spring rate of 0.0165 pounds/inch. In one embodiment, the valve member 58 is made from Delrin AF (Delrin acetil resin). The valve cap 140 is rotationally centered in the valve body 48 by a roll pin 142. The spring 74 urges or biases the valve member 58 downwardly so that the valve assembly 56 is urged toward the first position as shown in FIG. 5.

A distal end 80 of the valve member 58 includes a plug-shaped stop 82 juxtaposed in an air bleed passage bore hole 94 in the valve body 48. A V-ring 84 is seated on the valve member 58 between the stop 82 and the sealing disk 60 for sealing the air bleed passage 94 in the valve body 48. In the first position of the valve assembly 56 as shown in FIG. 5, the V-ring 84 and stop 82 are seated against the valve body 48 to seal off an air bleed port 92 in communication with the air bleed passage 94. The air bleed passage 94 is in communication with the primary vapor passage 50 upstream from the valve assembly 56. In the second position of the valve assembly 56, the valve member 58 translates to retract the disk 60 upwardly in FIG. 5 from sealing off the air bleed port 92 from the sealing configuration with the valve body 48 thereby opening the air bleed passage 94 for communication between the ambient atmosphere and the primary vapor passage 50.

In operation, the force of the spring 74 on the plate 72 keeps the valve member 58 in the first position as shown in FIG. 5 when refueling non-ORVR vehicles so that the primary passage 50 in the assembly 146 is unobstructed and the air bleed port 92 is closed and the slotted passage 62 is unblocked. When refueling non-ORVR vehicles, the vapor recovery system 24 in the fueling system 12 retrieves fuel vapors from the vehicle fuel tank 18 and pumps them to the ullage in the underground storage tank 30.

When refueling an ORVR 40 equipped vehicle 10, elevated vacuum levels in the primary vapor passage 50 result from the vacuum pump 38 in the vapor recovery system 24 in combination with the ORVR system 40. The elevated vacuum levels are communicated through the primary vapor passages 50 to a chamber 70 in the valve body in communication with the valve member 58. As a result of the elevated vacuum levels (or reduced pressure) in the chamber 70, the plate 72 moves upwardly to compress the spring 74. The movement of the plate 72 likewise moves the valve member 58 toward the second position and overcomes the bias of the spring 74 while the reduced pressure or elevated vacuum condition exists in the chamber 70. In one embodiment, the valve member 58 moves to the second position in response to a vacuum of about 0.5 to 4.0 inches $H_2O$. When a predetermined reduced vacuum level is reached the valve member 58 moves to the second position and then return to the first position when the vacuum level returns. These vacuum levels will vary depending upon certain operating conditions and parameters for the assembly 146.

As a result of the movement of the plate 72, compression of the spring 74 and translation of the valve member 58, the primary vapor passage 50 is blocked off because the slotted passage 62 is blocked by the disk 60 and no longer allows for the flow of vapor in the primary vapor passage 50 through the assembly 146. Moreover, the vacuum of the vapor recovery system 24 is blocked from communicating with the ORVR system 40. The valve member 58 in the second position blocks off the primary vapor passage 50 from the vacuum pump 38 of the vapor recovery system 24 and opens up the primary vapor passage 50 to the air bleed port 92. The size of the air bleed port 92 can be adjusted for compatibility with the containment pumping action of the ORVR system to maintain the desired vacuum level in the passage 50 to keep the valve member 58 in the second position. Once the ORVR fueling event concludes, the vacuum level in the chamber is reduced and the spring 74 expands and the disk is once again urged against the valve body 48 and the air bleed port 92 is closed and the primary vapor passage 50 is opened through the compatibility assembly 46.

Additional aspects of this invention include the use of a sensor (not shown) to detect an ORVR refueling vent. In one aspect, the linear motion of the valve member 58 of the ORVR compatibility assembly 46 or 146 is used as the basis for a transducer or sensor to detect an ORVR refueling event to consequently turn off the vapor pump 38 of the vapor recovery system 24 during an ORVR refueling event. The response time of the valve member 58 is quick enough that the resulting reduction in vapor (air) flow through the primary vapor passage 50 would be at or near 100%.

Additionally, the assembly 146 of FIG. 5 is used in combination with assembly 46 of FIGS. 2–3 or FIG. 4 to provide for enhanced performance and compatibility between the ORVR system 40 and the vapor recovery system 24.

Moreover, this invention could be utilized in combination with an ORVR nozzle as described in U.S. Provisional Patent Application Ser. No. 60/461,097 and incorporated herein by reference. The retrofit of an existing fuel system 12 to accomplish such an improvement is a simple matter of hanging a new valve and nozzle assemble in the fuel system. It should be appreciated by those of ordinary skill in the art that the retrofit of existing fuel systems is easily accomplished with the implementation and installation of an ORVR compatibility assembly 46, 146 as described herein. Additionally, the installation of new fuel systems preferably includes an ORVR compatibility assembly 46 as incorporated into the fuel nozzle, in communication with the hose or anywhere in the vapor recovery system of the fueling system.

From the above disclosure of the general principles of the present invention and the preceding detailed description of at least one preferred embodiment, those skilled in the art will readily comprehend the various modifications to which this invention is susceptible. Therefore, I desire to be limited only by the scope of the following claims and equivalents thereof.

I claim:

1. An ORVR compatibility assembly for use in a fueling system in which fuel from a storage tank is pumped through a hose to a nozzle for discharge into a fuel tank of a vehicle, the fueling system including a vapor recovery system to recover fuel vapors displaced from the fuel tank during fueling, the assembly comprising:

a primary vapor passage adapted to be in fluid communication with the vapor recovery system;

a valve assembly moveable between first and second positions, the first position permitting the uninterrupted flow of vapors through the primary vapor passage and the second position inhibiting the flow of vapors through the primary vapor passage, the valve assembly being biased toward the first position;

an air bleed passage in fluid communication with the primary vapor passage;

a stop on the valve assembly and moveable between open and closed positions, the stop in the closed position closing the air bleed passage when the valve assembly is in the first position; and wherein when the air pressure in the primary vapor passage is reduced to a predetermined level, the valve assembly moves from the first position to the second position and thereby inhibits flow through the primary vapor passage and vents the primary vapor passage through the air bleed passage when the stop moves to the open position.

2. The assembly of claim 1 wherein the primary vapor passage is exposed to ambient atmosphere when the stop is in the open position and the valve assembly is in the second position.

3. The assembly of claim 1 wherein the valve assembly comprises:

a valve member having a valve passage aligned with the primary vapor passage and through which vapors flow when the valve assembly is in the first position; and a valve body having a bore in which the valve member is seated for reciprocal movement to and between the first and second positions.

4. The assembly of claim 3 wherein the stop is a distal end of the valve member and includes a V-shaped sealing ring for sealing the air bleed passage.

5. The assembly of claim 1 further comprising:

a spring biasing the valve assembly toward the first position.

6. The assembly of claim 5 wherein the stop and the spring are located at opposite ends of the valve assembly.

7. An ORVR compatibility assembly for use in a fueling system in which fuel from a storage tank is pumped through a hose to a nozzle for discharge into a fuel tank of a vehicle, the fueling system including a vapor recovery system to recover fuel vapors displaced from the fuel tank during fueling, the assembly comprising:

a primary vapor passage adapted to be in fluid communication with the vapor recovery system;

a valve member moveable within a bore of a valve body between first and second positions, the first position permitting the uninterrupted flow of vapors through the primary vapor passage and the second position inhibiting the flow of vapors through the primary vapor passage, the valve member having a valve passage aligned with the primary vapor passage and through which vapors flow when the valve member is in the first position;

a spring located in the valve body biasing the valve member toward the first position;

an air bleed passage in fluid communication with the primary vapor passage; and a stop on the valve member moveable between open and closed positions, the stop in the closed position closing the air bleed passage when the valve assembly is in the first position, the stop in the open position opening the air bleed passage so that the primary vapor passage is open to ambient atmosphere when the valve member is in the second position; and wherein when the air pressure in the primary vapor passage is reduced to a predetermined level, the valve member moves from the first position to the second position thereby inhibiting flow through the primary vapor passage and venting the primary vapor passage through the air bleed passage when the stop moves to the open position.

8. The assembly of claim 7 wherein the stop is a distal end of the valve member and includes a V-shaped sealing ring for sealing the air bleed passage.

9. A fueling system comprising:

a storage tank for storing fuel;

a hose for transferring the fuel from the storage tank;

a pump operably coupled to the hose for pumping the fuel through the hose;

a nozzle coupled to the hose for dispensing the fuel into a fuel tank of a vehicle;

a vapor recovery system for recovering vapors displaced from the fuel tank, the vapor recovery system including a pump for pumping the vapors from the fuel tank and a vapor passage in the hose through which the vapors are removed from the fuel tank; and an ORVR compatibility assembly comprising:

a valve body having a primary vapor passage that is coupled to the vapor passage in the hose and a valve assembly moveable between first and second positions, the first position permitting the uninterrupted flow of vapors through the primary vapor passage and the second position inhibiting the flow of vapors through the primary vapor passage, the valve assembly being biased toward the first position;

an air bleed passage in fluid communication with the primary vapor passage and ambient atmosphere;

a stop on the valve assembly and moveable between open and closed positions, the stop in the closed position closing the air bleed passage when the valve assembly is in the first position; and wherein when the air pressure in the primary vapor passage is reduced to a predetermined level, the valve assembly moves from the first position to the second position thereby inhibiting flow through the primary vapor passage and venting the primary vapor passage through the air bleed passage when the stop moves to the open position.

10. The system of claim 9 wherein the primary vapor passage is exposed to ambient atmosphere through the air bleed passage when the stop is in the open position and the valve assembly is in the second position.

11. The system of claim 9 wherein the valve assembly comprises:

a valve member having a valve passage aligned with the primary vapor passage and through which vapors flow when the valve assembly is in the first position; and wherein the valve body has a bore in which the valve member is seated for reciprocal movement to and between the first and second positions.

12. The system of claim 9 wherein the stop is a distal end of the valve member and includes a V-shaped sealing ring for sealing the air bleed passage.

13. The system of claim 9 further comprising:

a spring located in the ORVR compatibility assembly and biasing the valve assembly toward the first position.

14. The system of claim 9 wherein the ORVR compatibility assembly is connected to the hose adjacent the nozzle.

15. A fueling system comprising:

a storage tank for storing fuel;

a hose for transferring the fuel from the storage tank;

a pump operably coupled to the hose for pumping the fuel through the hose;

a nozzle coupled to the hose for dispensing the fuel into a fuel tank of a vehicle;

a vapor recovery system for recovering vapors displaced from the fuel tank, the vapor recovery system including a pump for pumping the vapors from the fuel tank and a primary vapor passage in the hose through which the vapors are removed from the fuel tank; and an ORVR compatibility assembly comprising:

a valve member moveable within a bore of a valve body between first and second positions, the first position permitting the uninterrupted flow of vapors through the primary vapor passage and the second position inhibiting the flow of vapors through the primary vapor passage, the valve member having a valve passage aligned with the primary vapor passage and through which vapors flow when the valve member is in the first position;

a spring located in the valve body and biasing the valve member toward the first position;

an air bleed passage in fluid communication with the primary vapor passage; and a stop on the valve member and moveable between open and closed positions, the stop in the closed position closing the air bleed passage when the valve assembly is in the first position, the stop in the open position opening the air bleed passage so that the primary vapor passage is open to ambient atmosphere when the valve assembly is in the second position;

wherein when the air pressure in the primary vapor passage is reduced to a predetermined level, the valve assembly moves from the first position to the second position thereby inhibiting flow through the primary vapor passage and venting the primary vapor passage through the air bleed passage when the stop moves to the open position.

16. The system of claim 15 wherein the stop is a distal end of the valve member and includes a V-shaped sealing ring for sealing the air bleed passage.

17. The system of claim 15 wherein the ORVR compatibility assembly is connected to the hose adjacent the nozzle.

18. A method of dispensing fuel from a storage tank to a vehicle, the method comprising the steps of:

pumping the fuel from the storage tank through a hose;

dispensing the fuel from the hose through a nozzle into a fuel tank of the vehicle;

recovering vapor displaced from the fuel tank through a primary vapor passage for return to the storage tank;

biasing a valve member in communication with the primary vapor passage toward an open position permitting the flow of the vapor through the primary vapor passage; and closing the valve member and thereby blocking the primary vapor passage between the fuel tank and the storage tank in response to decreased pressure levels in the primary vapor passage resulting from operation of an on board vapor recovery system of the vehicle recovering the vapor displaced from the fuel tank.

19. The method of claim 18 further comprising:

venting the primary vapor passage when the valve member is closed.

20. The method of claim 18 further comprising:

opening the valve member in response to increased pressure levels in the primary vapor passage after cessation of the operation of the on board vapor recovery system.

21. A method of modifying a fueling system to provide for compatibility of a vapor recovery system of the fueling system and an on board vapor recovery system of a vehicle receiving fuel from the fueling system, the method comprising the steps of:

installing a valve member in communication with a primary vapor passage through which vapor displaced from a fuel tank of the vehicle during a fueling operation is intended to be returned to a storage tank of the fueling system;

biasing the valve member in communication with the primary vapor passage toward an open position permitting the flow of vapor through the primary vapor passage; and closing the valve member and thereby blocking the primary vapor passage between the fuel tank and the storage tank in response to decreased pressure levels in the primary vapor passage resulting from operation of an on board vapor recovery system of the vehicle recovering the vapor displaced from the fuel tank.

22. The method of claim 21 wherein installing the valve member comprises:

coupling the valve member to a hose through which the fuel is delivered to the vehicle via a nozzle and the vapors displaced from the fuel tank are intended to be transferred in the primary vapor passage to the storage tank.

23. The method of claim 22 wherein the valve member is coupled to the hose adjacent the nozzle.

24. The method of claim 21 further comprising:

venting the primary vapor passage when the valve member is closed.

* * * * *